US005156137A

United States Patent [19]

Clayton

[11] Patent Number: 5,156,137

[45] Date of Patent: Oct. 20, 1992

[54] PROJECTILE LAUNCHER

[76] Inventor: Richard A. Clayton, 10200 Hillview Ave., Chatsworth, Calif. 91311

[21] Appl. No.: 663,563

[22] Filed: Mar. 4, 1991

Related U.S. Application Data

[63] Continuation-in-part of Ser. No. 408,283, Sep. 18, 1989, abandoned.

[51] Int. Cl.[5] ..... F41B 7/00

[52] U.S. Cl. ..... 124/27; 124/37; 124/48

[58] Field of Search ..... 124/27, 26, 48, 83, 124/37, 31, 39

[56] References Cited

U.S. PATENT DOCUMENTS

| | | | |
|---|---|---|---|
| 2,625,927 | 1/1953 | Rosenbloom | 124/48 X |
| 2,888,004 | 5/1959 | Steiner | 124/27 |
| 2,977,950 | 4/1961 | Ryan | 124/27 |
| 3,009,453 | 11/1961 | Ayala | 124/27 |
| 3,465,744 | 9/1969 | Nielsen | 124/27 |
| 3,757,760 | 9/1973 | Darnell | 124/48 X |
| 3,773,026 | 11/1973 | Romero | 124/48 X |
| 3,774,586 | 11/1973 | Saito | 124/48 X |
| 3,916,867 | 11/1975 | Marshall | 124/37 X |

*Primary Examiner*—Peter M. Cuomo

[57] ABSTRACT

A projectile launching device is disclosed herein having, in its simplest form, a single elongated launching tube or barrel, onto the rearward end of which is pivotally mounted a lever assembly having a latch member and a release member coupled to one another about the pivot. The release member extends across the rearward end of the barrel and the latch member extends forwardly along the barrel. The barrel is open at its forward end to receive a shaftlike projectile. A hook is carried at the forward end of the latch member to protrude through a slot radially into the barrel for engagement with a tab on the projectile shaft. A spring, housed inside the barrel, rests against the release member of the lever assembly such that when a projectile is inserted into the barrel it compresses the spring against the release member and pivots the lever assembly to force the hook into the barrel and into engagement with the projectile tab, thereby preventing the spring from ejecting the projectile from the barrel. A trigger operated hammer as might be found in a conventional firearm is pivotally coupled to a barrel supporting frame to allow the hammer's striking surface to strike the release member at the rearward end of the barrel to pivot the lever assembly to a releasing position which disengages the hook from the tab on the projectile, allowing the spring to launch the projectile from the barrel.

8 Claims, 1 Drawing Sheet

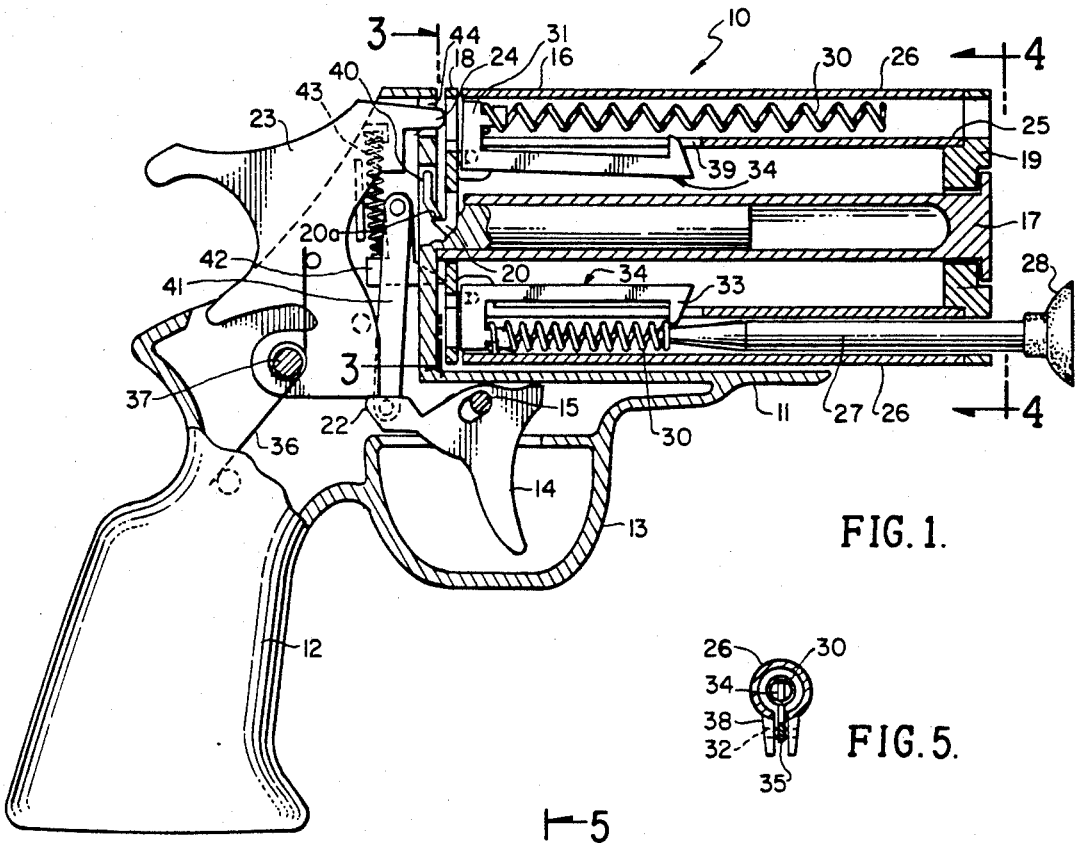
FIG. 1.
FIG. 5.
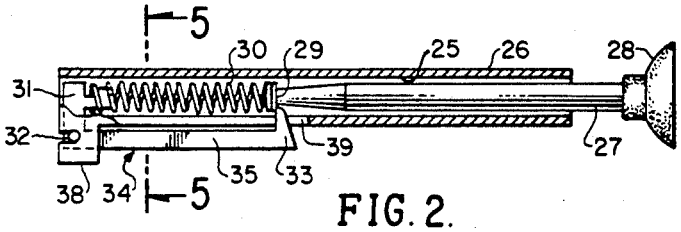
FIG. 2.
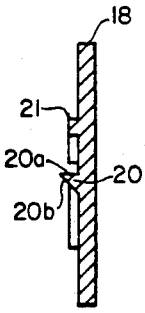
FIG. 6.
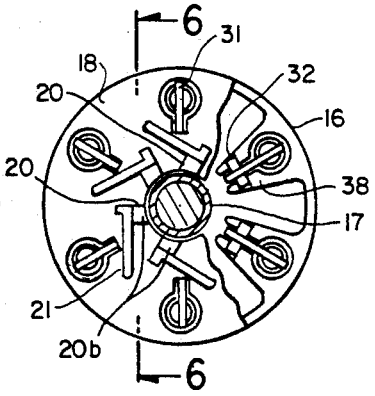
FIG. 3.
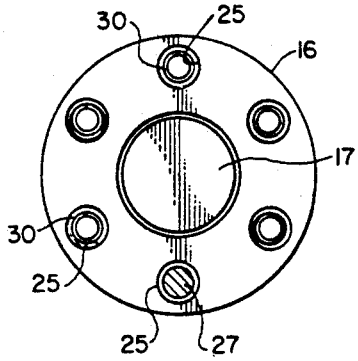
FIG. 4.

PROJECTILE LAUNCHER

This application is a continuation-in-part of application Ser. No. 408,283, filed Sept. 18, 1989, now abandoned.

BACKGROUND OF THE INVENTION

1. Field of the Invention

The present invention relates to spring operated mechanical guns, and more particularly to a novel such gun wherein one or more spring loaded projectiles are launched sequentially through the actions of a trigger and a hammer similar to those found in conventional firearms.

2. Brief Description of the Prior Art

In the past, spring loaded projectile launchers, such as dart guns or the like, have employed a latch means, for the retention of a shaftlike projectile within a barrel, comprising a pivotally carried lever having permanently affixed to it a hook for engagement with the projectile and a finger operated trigger for pivoting the lever to disengage the hook for launch of the projectile. Such devices are generally limited to single-shot capability and must be reloaded after each launching of a single projectile.

Steiner U.S. Pat. No. 2,888,004 discloses a device for retaining and launching a plurality of projectiles which uses the aforementioned "pivoted lever, hook and trigger" latch structure. Steiner U.S. Pat. No. '004 achieves this capability by assembling a plurality of barrels 20, each provided with a latch 28 having the form previously described. Problems and difficulties are encountered with such a device due to the fact that a single finger operated trigger cannot be employed to selectively release the projectiles as would be the case in a conventional revolver or similar firearm. Rather, separate triggers must be actuated for each of the individual darts.

Ayala U.S. Pat. No. 3,009,453 discloses a dart gun having a rotatably carried magazine comprising a plurality of barrels and darts in which a single finger operated trigger selectively releases the darts. Ayala U.S. Pat. No. '453 employs a variation of the previously described latch construction in which a pivoted-trigger-and-lever assembly is made separate from the hook. A magazine 29 is constructed for multiple projectiles 30 to be interfaced with one pivoted-trigger-and-lever assembly 59, 28, 62, 63, 65, 66, 67 wherein each projectile 30 is retained in the magazine 29 by a dedicated spring biased hook 53. Problems and difficulties are encountered with such a projectile launcher which stem largely from certain functional constraints:

To effectively disengage hook 53 from projectile tab 50, hook 53 must be withdrawn radially from within the projectile passageway or barrel 46. Therefore, any release means provided must necessarily be oriented to engage and deliver releasing force to the selected hook 53 in a direction perpendicular to the longitudinal axis of barrel 46. Such is the orientation of Ayala's trigger operated releasing lever 65, 66, 67.

In conventional revolvers the firing or releasing force is delivered by a hammer in the forward direction directly into the longitudinal axis of the barrel. Thus, latch means construction as taught by Ayala will not work with release means like that of a conventional gun which fires a gunpowder charged cartridge.

Further, Ayala U.S. Pat. No. '453 employs a pump type mechanism 14, 15, 40, 41, 43, 44, independent of the trigger 59 and requiring two hands for operation, to advance the barrels 46 successively into firing position. In a conventional revolver such magazine advancement is automatic. This typically involves a pawl being pivotally coupled to the trigger or hammer and biased to engage the rear exterior of the magazine, such that during a portion of the trigger's operating cycle, vertical displacement of the trigger assembly perpendicular to the longitudinal axis of the magazine is translated into rotation of the magazine about that axis in an angular amount equal to 360 degrees divided by the number of barrels comprised by the magazine. For a typical magazine of six barrels or less, this requires the trigger assembly to have during its operating stroke a significant vertical displacement at the interface between trigger assembly and magazine.

It can be seen that due to the proximity of Ayala's U.S. Pat. No. '453 fulcrum 63 to the rear plate 31 of magazine 29 and due to the limited movement allowed lever 62 by guide tube 35, there is negligible vertical displacement of either trigger lever 62 or trigger lever 65 at the interface between the pivoted-trigger-and-lever assembly 59, 28, 62, 63, 65 and magazine 29. It might be suggested that modifications could be made to the fulcrum location, or to guides limiting motion of trigger levers 62, 65, or that an advancement interface could be constructed between the interior of magazine 29 and the pivoted-trigger-and-lever assembly members 66, 67 having greater range of motion, whereby sufficient rotation could be achieved. However, applicant submits that such modifications would have interfering effects on other mechanisms and components of the device ultimately resulting in the need for substantial alterations outside the scope of those normally skilled in the art.

Therefore, it may be observed that a spring operated mechanical gun having latching means as taught by Ayala U.S. Pat. No. '453 will not work with the releasing hammer of a conventional gun and that a gun having releasing means as taught by Ayala U.S. Pat. No. '453 will not work with the magazine advancement mechanism of a conventional revolver.

Therefore, a long-standing need has existed to provide a projectile launcher or dart gun for retaining and launching a plurality of shaftlike projectiles or darts, having a projectile magazine which requires no interface with the body of the gun aside from that normally associated with a conventional revolver, i.e.:

a means provided by the gun for rotational mounting of the magazine about its longitudinal axis;

a hammer provided by the gun aligned to strike forwardly along the longitudinal axis of the barrel and projectile in firing position; and a pawl provided by the gun to translate motion of the gun's trigger to rotational motion of the magazine.

Additionally, in the past it has been conventional practice to employ, in revolvers and toy guns simulating the actions of revolvers, magazine advancement means wherein the magazine is rotated during the portion of the trigger operating cycle from rest position to firing position, immediately prior to the firing stroke of the hammer.

Ryan U.S. Pat. No. 2,977,950 demonstrates such a magazine advancement mechanism in which a pawl 100 carried on hammer 75 engages ratchet teeth 38 to rotate cylinder 18 as hammer 75 is drawn rearward from its rest position by actuation of trigger 85.

This and other magazine advancement mechanisms which rotate the magazine as the trigger is drawn from a rest position toward a firing position have the disadvantage, with consideration to suction cup type darts, that the suction cup of a dart in or approaching firing position, due to its large diameter with respect to that of the dart shaft, is in view of an operator sighting down the barrel, and movement of suction cups as the trigger is actuated poses a distraction from aiming the gun.

Therefore, a need exists to provide a novel magazine advancement means which actuates in response to the return of the trigger means from its firing position to the initial rest position, following the firing stroke of the hammer, thereby allowing the magazine to remain stationary during a time period including the portion of the trigger operating cycle from rest position to firing position and the firing stroke of the hammer.

SUMMARY OF THE INVENTION

Accordingly, the above problems and difficulties are obviated by the present invention which provides a novel mechanical gun, capable of discharging suction cup darts, or similar projectiles, through the action of a conventional trigger and hammer, and means for constructing a magazine of multiple projectiles, capable of interfacing with a revolver type magazine advancement mechanism, or other means for automatically advancing projectiles to the firing position in response to an operating cycle of the trigger.

The present invention employs a variation of the "pivoted lever, hook and trigger" latch structure of the prior art wherein a pivoted-lever-and-hook assembly is made separate from a trigger. A separate pivoted-lever-and-hook assembly is carried on the magazine for each barrel provided. Inclusion of the pivoted levers on the magazine, along with the specific geometry of the lever, allows the required radially withdrawing motion of the hook, outward from the barrel, to be derived from force delivered to the lever into and along the longitudinal axis of the barrel. Thus, a projectile may be released by action of a conventional hammer on the lever of a barrel in firing position.

The present invention further employs a novel magazine advancement mechanism which utilizes the force of a trigger return spring to engage a trigger mounted pawl assembly with a set of ratchet teeth on the magazine so as to advance the barrels successively into alignment with the hammer during the return of the trigger from its firing position to its rest position. Novel retaining means are provided, engageable between the gun body and the magazine, to maintain alignment of the hammer and barrel and to prevent undesired rotation of the magazine.

Therefore it is among the primary objectives of the present invention to provide a novel spring loaded dart gun which simulates the action of a gunpowder loaded gun in that the projectile retaining means is adapted to release a projectile when struck by a hammer such as one typical of conventional firearms.

Another object of the present invention is to provide a novel dart magazine, comprising a plurality of spring launched darts, which is operable with a conventional revolver type magazine advancement mechanism, or similar means for automatically advancing projectiles to the firing position in response to an operating cycle of the trigger.

Still another object of the present invention is to provide a toy gun having a novel means for automatically advancing a magazine of multiple projectiles, wherein the magazine is advanced during the portion of the trigger operating cycle in which the trigger returns from its firing position to its rest position.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a side elevational view, partly in section, of a novel mechanical gun incorporating the present invention;

FIG. 2 is a longitudinal cross-sectional view of a projectile and barrel employed in the device of FIG. 1;

FIG. 3 is an end elevational view, partly in section, of the projectile carrying magazine of the device taken in the direction of arrows 3—3 of FIG. 1;

FIG. 4 is an end elevational view taken in the direction of arrows 4—4 of FIG. 1;

FIG. 5 is a transverse cross-sectional view of the barrel taken in the direction of arrows 5—5 of FIG. 2; and FIG. 6 is a transverse cross-section of the rear plate of the projectile carrying magazine taken in the direction of arrows 6—6 of FIG. 3.

DESCRIPTION OF THE PREFERRED EMBODIMENT

Referring to FIG. 1, there is shown by way of illustration, but not of limitation, a mechanical pistol 10 designed and constructed in accordance with this invention. The pistol includes a body 11, having a handle 12, trigger guard 13, a shaft 17 for rotatably mounting a cylindrical magazine 16, a shaft 15 for pivotally mounting a trigger 14, and a shaft 37 for pivotally mounting a hammer 23. The magazine 16 comprises six tubular barrels 26 equally spaced about the longitudinal axis of magazine 16, a plate 19 adapted to support barrels 26 at the forward end of shaft 17 or the end most distant from body 11, and a plate 18 adapted to support barrels 26 about the rearward end of shaft 17 and to interface and engage with a magazine advancement means described later in this text.

Each barrel 26 has a central passageway 25 along its longitudinal axis and is fitted with a lever assembly generally indicated in FIG. 1 by reference numeral 34. Lever assembly 34 comprises a release member 31, joined in a 90 degree angle to a latch member 35, about a pair of mounting shafts 32. Latch member 35 includes a hook 33 at its forward end. Lever assembly 34 is pivotally mounted at the rearward end of barrel 26 through engagement of mounting shafts 32 with receptacles 38, such that release member 31 is positioned generally perpendicular to the longitudinal axis of passageway 25. Receptacles 38 are offset from the longitudinal axis of barrel 26 such that latch member 35 is positioned outside of passageway 25 generally parallel to the longitudinal axis of passageway 25. Plate 18 secures the mounting shafts 32 in receptacles 38. A launch spring 30 is carried longitudinally within passageway 25 such that its rearward end is in contact with release member 31.

Loading of a barrel 26 is achieved by inserting the rearward end of a projectile shaft 27, which in the present instance carries a suction cup 28 on its forward end, into the forward end of passageway 25 at plate 19, and further inserting shaft 27 until a tab 29 on shaft 27 slides rearward beyond hook 33. Compression of launch spring 30 against lever assembly release member 31 pivots lever assembly 34 to a latching position wherein hook 33 protrudes through slot 39 into passageway 25, and urges shaft 27 outward from passageway 25 such that tab 29 and hook 33 are locked together, thereby preventing launch spring 30 from further ejecting shaft 27.

FIG. 1 depicts the pistol 10 with trigger 14 in its rest position and hammer 23 in its normal position. Firing of pistol 10 and advancement of magazine 16 are achieved as follows. A projection 22 on trigger 14 engages hammer 23 such that pivotal motion of trigger 14 in the direction of handle 12 causes hammer 23 to pivot about shaft 37, and the hammer striking member 24 is drawn rearwardly away from magazine 16. Pivotal motion of trigger 14 also moves an arm 41, which is pivotally mounted to trigger 14, upward within body 11. A pawl 42 is pivotally coupled to the upper end of arm 41, such that the assembly of arm 41 and pawl 42 forms a small angle about the point of coupling. Pawl 42 is urged by return spring 43 into contact with plate 18. Plate 18 comprises on its rearward side six equally spaced ratchet teeth 20 and six equally spaced guides 21. As trigger 14 pivots, pawl 42 slides upward on plate 18 next to a guide 21 in the position indicated by the numeral 21 in FIG. 3 and engages the sloping side **20*b* of a ratchet tooth 20 from which the guide 21 extends. A detent 40 engages the horizontal face 20*a* of tooth 20. When tooth 20 and detent 40 are thus engaged, one passageway 25 is aligned with opening 44 of body 11, and magazine 16 is restricted from rotation in the direction opposite that of magazine advancement. Continued pivotal motion of trigger 14 to its firing position causes pawl 42 to slide up and over tooth 20, adjacent to detent 40, and causes hammer 23 to pivot to its reverse position, where it no longer engages projection 22 of trigger 14. A firing spring 36, which is torsionally compressed between body 11 and hammer 23, drives hammer 23 back toward its normal position. Inertia carries hammer 23 beyond the normal position to its forward position such that striking member 24 passes through opening 44 into contact with release member 31 to pivot lever assembly 34 to the releasing position wherein hook 33 is withdrawn from passageway 25, allowing launch spring 30 to eject shaft 27. When trigger 14 is released, return spring 43 forces pawl 42, arm 41 and projection 22 downward to pivot trigger 14 back toward its rest position. Return spring 43 also urges pawl 42 into contact with plate 18, so that as pawl 42 moves downward it engages the horizontal face 20*a* of tooth 20 to rotate magazine 16 about shaft 17. This engagement of pawl 42 and tooth 20 additionally has a self-reinforcing action as it tends to pivot pawl 42 in a counter-clockwise direction as viewed in FIG. 1 whereby pawl 42 is urged into tighter contact with plate 18. As trigger 14 retracts completely from firing position to rest position, the engagement of pawl 42 with tooth 20 rotates magazine 16 by one sixth of one revolution, such that the next passageway 25 in magazine 16 is in alignment with opening 44 and hammer 23. When trigger 14 reaches rest position, pawl 42 engages a guide 21 extending from the next tooth 20 in position for engagement with pawl 42, thereby preventing further rotation of magazine 16**.

Accordingly, it can be seen that the novel launching apparatus of the present invention provides a plurality of spring loaded projectile launchers compatible with commonly used suction cup darts or similar projectiles, held in a revolving cylinder carried on the body of a gun which uses a conventional trigger and hammer type firing mechanism. The invention provides a simple interface between the magazine and the firing mechanism, and provides an improved magazine advancement mechanism for improved sighting and aesthetic value.

While particular embodiments of the present invention have been shown and described, it will be obvious to those skilled in the art that changes and modifications may be made without departing from this invention in its broader aspects and, therefore the aim in the appended claims is to cover all such changes and modifications as fall within the true spirit and scope of this invention.

What is claimed is:

1. A projectile launching apparatus comprising:

a body;

a trigger pivotally carried on said body, about a trigger mounting shaft, for travel between a rest position and a firing position;

at least one elongated barrel, carried on said body, having a forward end and a rearward end and having a tubular passageway adapted at said forward end to releasably receive and carry a projectile;

said projectile comprising a shaft having a tab positioned generally perpendicular to a longitudinal axis of said shaft;

a launch spring carried within said passageway being engageable with said projectile to normally bias said projectile out of said passageway;

a lever assembly comprising a release member and a latch member coupled about a pivot;

said pivot being operably carried at the rearward end of said barrel for movement of said lever assembly between a latching position and a releasing position;

said latch member extending forwardly from said pivot substantially parallel to a longitudinal axis of said passageway and comprising a hook releasably engageable with said tab on said projectile shaft when said level assembly is in said latching position to hold said projectile within said passageway against said normal bias of said launch spring;

said hook being withdrawn radially from said passageway for disengagement from said tab on said projectile shaft when said level assembly is in said releasing position;

said release member of said lever assembly extending from said pivot across said rearward end of said barrel so as to intersect said longitudinal axis of said passageway;

said release member being rocked rearwardly along said longitudinal axis of said passageway when said level assembly is pivoted to said latching position and being rocked forwardly when said lever assembly is pivoted to said releasing position;

a hammer pivotally carried on said body, about a hammer mounting shaft, for travel between a forward position and a reverse position and having a normal position between said forward position and said reverse position;

said hammer comprising a striking member;

said striking member being in substantial alignment with and having mobility in substantial alignment with said longitudinal axis of said passageway when said hammer is in said forward position;

a projection on said trigger for engagement with said hammer whereby pivotal movement of said trigger from said rest position to said firing position pivots said hammer from said normal position to said reverse position, and whereby arrival of said trigger at said firing position effects disengagement of said hammer from said trigger projection due to angular displacement of said trigger and said hammer relative to one another;

a firing spring being engageable between said body and said hammer when said hammer is in said reverse position whereby said firing spring forces said hammer, once said hammer is disengaged from said trigger projection, from said reverse position to said forward position;

said firing spring providing sufficient force to said hammer to drive said lever assembly from said latching position to said releasing position;

said striking member of said hammer being engageable with said release member of said lever assembly when said hammer is in said forward position to force said lever assembly to said releasing position whereby said hook is withdrawn from engagement with said tab on said projectile shaft to release said projectile and permit expansion of said launch spring.

2. A projectile launching apparatus comprising:

a body;

a trigger pivotally carried on said body, about a trigger mounting shaft, for forward and reverse travel between a rest position and a firing position;

a magazine movably carried on said body comprising a plurality of elongated barrels in parallel spaced relationship;

each of said barrels having a forward end and a rearward end and having a longitudinal passageway adapted at said forward end to releasably receive and carry a projectile;

said projectile comprising a shaft having a tab positioned generally perpendicular to a longitudinal axis of said shaft;

a launch spring carried within each of said passageways being engageable with said projectile to normally bias said projectile out of said passageway;

each of said barrels provided with a lever assembly comprising a release member and a latch member coupled about a pivot;

said pivot being operably carried on said magazine at said rearward end of each of said barrels at a location offset from a longitudinal axis of said passageway for movement of said lever assembly between a latching position and a releasing position;

said latch member extending forwardly from said pivot substantially parallel to a longitudinal axis of said passageway and comprising a hook releasably engageable with said tab on said projectile shaft when said lever assembly is in said latching position to hold said projectile within said passageway against said normal bias of said launch spring;

said hook being withdrawn radially from said passageway for disengagement from said tab on said projectile shaft when said lever assembly is pivoted to said releasing position;

said release member of said lever assembly extending from said pivot across said rearward end of said passageway in a generally diametric manner so as to intersect and longitudinal axis of said passageway;

said release member being rocked rearwardly along said longitudinal axis of said passageway when said lever assembly is pivoted to said latching position and being rocked forwardly when said lever assembly is pivoted to said releasing position;

a hammer pivotally carried on said body, about a hammer mounting shaft, for travel between a forward position and a reverse position and having a normal position between said forward position and said reverse position;

said passageways being selectively alignable with said hammer;

said hammer comprising a striking member;

said striking ember being in substantial alignment with and having mobility in substantial alignment with the longitudinal axis of a selected passageway when said hammer is in said forward position;

a projection on said trigger for engagement with said hammer whereby pivotal movement of said trigger from said rest position to said firing position pivots said hammer from said normal position to said reverse position, and whereby arrival of said trigger at said firing position effects disengagement of said hammer from said trigger projection due to angular displacement of said trigger and said hammer relative to one another;

a firing spring being engageable between said body and said hammer when said hammer is in said reverse position whereby said firing spring forces said hammer, once said hammer is disengaged from said trigger projection, from said reverse position to said forward position;

said firing spring providing sufficient force to said hammer to drive said lever assembly from said latching position to said releasing position;

said striking member of said hammer being engageable with said release member of said lever assembly of said selected passageway when said hammer is in said forward position to force said lever assembly to said releasing position whereby said hook is withdrawn from engagement with said tab on said projectile shaft to release said projectile and permit expansion of said launch spring.

3. The invention as defined in claim 2 including:

magazine advancement means;

said magazine advancement means being engageable with said magazine for imparting motion thereto to successively place said passageways into alignment with said hammer.

4. The invention as defined in claim 3 including:

a pawl coupled to said trigger;

a plurality of ratchet teeth coupled to a rearward end of said magazine;

said pawl being engageable with said ratchet teeth for imparting said advancement motion to said magazine in response to an operating cycle of said trigger.

5. The invention as defined in claim 4 including:

a return spring engaged between said body and said pawl to normally urge said trigger to said rest position and to normally bias said pawl toward said ratchet teeth;

said pawl and said ratchet teeth being oriented for engagement to impart an advancement motion to said magazine on return of said trigger from said firing position to said rest position.

6. A projectile launching apparatus comprising:

a body;

a trigger movably carried on said body for travel between a rest position and a firing position;

a magazine movably carried on said body comprising a plurality of elongated barrels in parallel spaced relationship;

each of said barrels having a forward end and a rearward end and having a longitudinal passageway adapted at said forward end to releasably receive and carry a projectile;

said projectile comprising a shaft having a tab positioned generally perpendicular to a longitudinal axis of said shaft;

a launch spring carried within each of said passageways being engageable with said projectile to normally bias said projectile out of said passageway;

each of said barrels provided with a lever assembly comprising a release member and a latch member coupled about a pivot;

said pivot being operably carried on said magazine at said rearward end of each of said barrels for movement of said lever assembly between a latching position and a releasing position;

said latch member extending forwardly from said pivot substantially parallel to a longitudinal axis of said passageway and comprising a hook releasably engageable with said tab on said projectile shaft when said lever assembly is in said latching position to hold said projectile within said passageway against said normal bias of said launch spring;

said hook being withdrawn radially from said passageway for disengagement from said tab on said projectile shaft when said lever assembly is pivoted to said releasing position;

said release member of said lever assembly extending from said pivot across said rearward end of said barrel so as to intersect said longitudinal axis of said passageway;

said release member being rocked rearwardly along said longitudinal axis of said passageway when said lever assembly is pivoted to said latching position and being rocked forwardly when said lever assembly is pivoted to said releasing position;

a trigger-actuated hammer movably carried on an body for travel between a forward position and a reverse position;

said barrels being selectively alignable with said hammer;

said hammer being engageable with said release member of a lever assembly of said selected barrel when said hammer is in said forward position to force said lever assembly to said releasing position whereby said hook is withdrawn from engagement with said tab on said projectile shaft to release said projectile and permit expansion of said launch spring;

a trigger-actuated magazine advancement means;

said magazine advancement means being engageable between said trigger and said magazine for imparting motion to said magazine to successively place said barrels into said alignment with said hammer in response to an operating cycle of said trigger from said rest position to said firing position to said rest position;

said magazine advancement means comprising a pawl linked to said trigger;

said pawl being engageable with said magazine for imparting said advancement motion thereto in response to said operating cycle of said trigger.

7. The invention as defined in claim 6 wherein:

said pawl imparts said advancement motion to said magazine in response to movement of said trigger from said firing position to said rest position;

said pawl being disengaged from said magazine during movement of said trigger from said rest position to said firing position.

8. The invention as defined in claim 6 including:

an elongated arm carried within said body for upward and downward travel between an upper position and a lower position;

said pawl being pivotally attached to one end of said arm to extend from said pivotal attachment generally toward an opposite end of said arm, and being pivotally offset from longitudinal axis of said arm such that said arm and said pawl forms a small angle about said pivotal attachment;

said opposite end of said arm being pivotally attached to said trigger to provide said linkage of said trigger and said pawl;

said magazine comprising a plurality of ratchet teeth on its rearward end;

a detent carried on said body being engageable with said ratchet teeth to restrict said magazine from rotating in the direction opposite that of said advancement motion;

said magazine comprising a plurality of elongated guides on its rearward end;

said ratchet teeth and said guides being selectively alignable with said pawl;

said arm being forced upward from said lower position to said upper position by movement of said trigger from said rest position to said firing position whereby said pawl slides upward parallel to said selected guide and past a selected ratchet tooth;

said arm moving downward from said upper position toward said lower position for movement of said trigger from said firing position toward said rest position whereby said pawl engages said selected ratchet tooth;

said pawl engaging said selected ratchet tooth to urge said pawl to pivot away from said arm and into tighter engagement with said selected ratchet tooth;

said engagement of said pawl and said selected ratchet tooth further serving to impart said advancement motion to said magazine during continued motion of said trigger from said firing position to said rest position;

said advancement motion of said magazine selectively and successively aligns said guides and said ratchet teeth with said pawl;

said guides being excessively engageable with said pawl as said arm moves from said upper position to said lower position to restrict said magazine from rotation beyond that required for advancement of said magazine.

* * * * *